US008267056B2

(12) United States Patent
Dean

(10) Patent No.: US 8,267,056 B2
(45) Date of Patent: Sep. 18, 2012

(54) SPLIT-CYCLE INTERNAL COMBUSTION ENGINE

(75) Inventor: Charles Dean, Royal Oak, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 379 days.

(21) Appl. No.: 12/724,461

(22) Filed: Mar. 16, 2010

(65) Prior Publication Data

US 2011/0226224 A1 Sep. 22, 2011

(51) Int. Cl.
*F02B 33/00* (2006.01)

(52) U.S. Cl. ..... 123/68; 123/70 R; 60/620

(58) Field of Classification Search ..... 123/68, 123/70 R; 60/39.6, 517, 597, 620
See application file for complete search history.

(56) References Cited

U.S. PATENT DOCUMENTS 2,110,248 A * 3/1938 Wagner ..... 123/52.3
* cited by examiner

*Primary Examiner* — Noah Kamen
(74) *Attorney, Agent, or Firm* — Quinn Law Group, PLLC

(57) ABSTRACT

A split-cycle internal combustion engine is disclosed. The engine includes a cylinder block, and a plurality of cooperating power pistons and cylinders mounted in the cylinder block. The power pistons are configured to be energized by forces of combustion. The engine also includes a compressor piston and cylinder configured to compress a volume of air and transfer the compressed air to the power pistons, and an expander piston and cylinder configured to receive exhaust gases from the power pistons. The engine additionally includes a first crankshaft operatively connected to and rotatably driven by the power pistons, a second crankshaft operatively connected to the compressor piston and configured to rotatably drive the compressor piston, and a third crankshaft operatively connected to the expander piston and configured to be rotatably driven by the expander piston. The first, second, and third crankshafts are operatively connected to each other for coordinated rotation.

20 Claims, 2 Drawing Sheets

SPLIT-CYCLE INTERNAL COMBUSTION ENGINE

TECHNICAL FIELD

The invention relates to a split-cycle internal combustion engine and use thereof.

BACKGROUND OF THE INVENTION

In a conventional Otto cycle internal combustion engine, each cylinder performs four strokes per cycle—intake, compression, power, and exhaust. As a result, two revolutions of the engine's crankshaft are required for each power stroke.

By contrast, a split-cycle engine divides these four strokes between at least two paired cylinders—one for intake/compression and another for power/exhaust. In some split-cycle engine configurations compressed air is transferred from the compression cylinder to the power cylinder through a transfer or crossover passage. Fuel is subsequently injected and fired in the power cylinder to produce the power stroke.

Additionally, in some split-cycle engines, an expander cylinder is also provided to take advantage of the energy contained in post-combustion exhaust gases to create additional mechanical work by allowing further gas expansion. In such a case, after the power stroke, exhaust gases are transferred from the power cylinder to the piston expander via an exhaust port or passage, thereby displacing the expander cylinder.

SUMMARY OF THE INVENTION

A split-cycle internal combustion engine is disclosed. The engine includes a cylinder block, and a plurality of cooperating power pistons and cylinders mounted in the cylinder block. The power pistons are configured to be energized by forces of combustion. The engine also includes a compressor piston and cylinder mounted in the cylinder block and configured to compress a volume of air and transfer the compressed air to the power pistons. The engine additionally includes an expander piston and cylinder mounted in the cylinder block and configured to receive products of combustion, i.e., exhaust gases, from the power pistons. Furthermore, the engine includes first, second, and third crankshafts that are operatively connected for coordinated rotation. The first crankshaft is operatively connected to, and is rotatably driven by the power pistons. The second crankshaft is operatively connected to, and is configured to rotatably drive the compressor piston. The third crankshaft is operatively connected to, and is configured to be rotatably driven by the expander piston.

The first, second, and third crankshafts may be disposed alongside and parallel relative to each other. The engine may include an intake port configured to transfer the compressed air from the compressor piston to each of the cooperating power pistons, and an exhaust port configured to transfer exhaust gases from each of the cooperating power pistons to the expander piston. The intake and exhaust ports may be arranged such that the compressor piston is positioned on one side of the plurality of cooperating power pistons, and the expander piston is positioned on the opposite side of the plurality of cooperating power pistons.

The engine may additionally include first, second, and third interconnected gears, wherein the first gear is connected to the first crankshaft, the second gear is connected to the second crankshaft, and the third gear is connected to the third crankshaft. The first, second, and third gears may be interconnected via at least one chain. The first, second, and third gears may be intermeshed, and the first gear may have a handed helix, while the second and third gears have an oppositely handed helix as compared to the handed helix of the first gear.

The engine may also include first, second, and third pulleys, wherein the first pulley is connected to the first crankshaft, the second pulley is connected to the second crankshaft, and the third pulley is connected to the third crankshaft. In such a configuration, the first, second and third pulleys may be operatively connected via at least one belt.

The first, second, and third crankshafts may be operatively connected for synchronous rotation. The second and third crankshafts may additionally be configured as balance shafts for smoothing-out operation of the engine.

A vehicle employing the above described split-cycle internal combustion engine is also disclosed.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
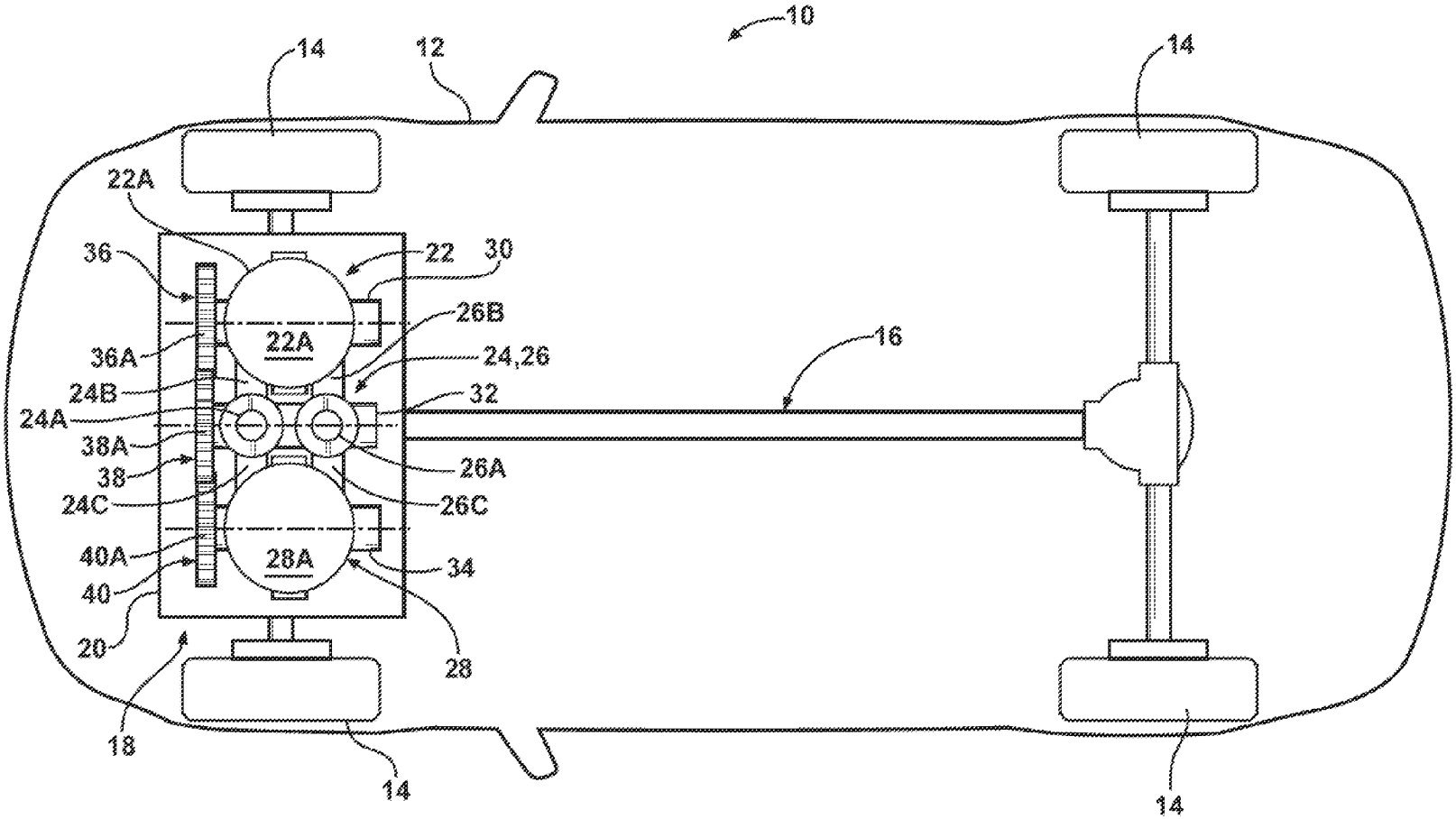
FIG. 1 is a schematic illustration of a vehicle employing for propulsion a split-cycle internal combustion engine with three crankshafts.

Referring to the drawings, wherein like reference numbers refer to like components, FIG. 1 shows a vehicle 10 having a body 12, and a plurality of wheels 14. Vehicle 10 employs a driveline 16 for transferring drive torque to wheels 14 from a split-cycle internal combustion engine 18. Not specifically shown, but as understood by those skilled in the art, driveline 16 may include a transmission, a driveshaft, and one or more differentials to transfer torque developed by split-cycle internal combustion engine 18 for powering vehicle 10.

Split-cycle engine 18 may also be employed in a hybrid vehicle application, as understood by those skilled in the art. In such an application, split-cycle engine 18 may be utilized in the capacity of a generator to charge an on-board vehicle energy-storage device, such as a battery pack, at high levels of efficiency and output. Additionally, split-cycle engine 18 may be used for stationary power production, i.e., a stationary generator application.

In general, and as understood by those skilled in the art, a split-cycle internal combustion engine offers improved efficiency over a conventional spark ignition (SI) or a compression ignition (CI) internal combustion engine. As shown, split-cycle engine 18 includes a cylinder block 20. The cylinder block 20 houses a compressor cylinder 22 and a pair of power cylinders 24 and 26. Engine 18 additionally includes an expander cylinder 28. Expander cylinder 28 is configured to create additional mechanical work by utilizing the energy contained in post-combustion exhaust gases. Consequently, the split-cycle engine 18 is a dual-compression, dual-expansion engine, which employs separate compressor cylinder 22 and separate expander cylinder 28 to augment compression and expansion functions, respectively, of power cylinders' 24 and 26.

A compressor piston 22A is mounted inside the compressor cylinder 22 and is adapted for reciprocating motion therein; a pair of power pistons 24A and 26A are individually mounted inside each of the power cylinders 24 and 26, and are adapted for reciprocating motion therein; and an expander piston 28A is mounted inside the expander cylinder 28 and is adapted for reciprocating motion therein. Compressor cylinder 22 is configured to draw a volume of ambient air in on a down stroke of the piston 22A, compress the volume of air and transfer the compressed air to power cylinders 24 and 26 on an up stroke of the subject piston. Compressor cylinder 22 transfers compressed air to power cylinders 24 and 26 via intake transfer ports 24B and 26B, respectively. Intake transfer ports 24B and 26B are typically part of either an intake manifold or a cylinder head, neither of which is shown, but each are known by those skilled in the art. Fuel is introduced periodically into each of the power cylinders 24 and 26 via a fuel delivery and injection system (not shown) along with, or shortly after the compressed air is delivered to each respective cylinder. As understood by those skilled in the art, fuel and air combine to produce an air-fuel mixture for subsequent firing and combustion inside cylinders 24 and 26. The power pistons 24A and 26A are prompted into sustained reciprocating motion by successive firing of the fuel-air mixture inside the respective cylinders.

Engine 18 additionally employs three separate crankshafts 30, 32, and 34, disposed alongside and parallel relative to each other. Crankshaft 30 is a compressor cylinder crankshaft operatively connected to and configured to rotatably drive piston 22A; crankshaft 32 is a power cylinder crankshaft operatively connected to and rotatably driven by pistons 24A and 26A; and crankshaft 34 is an expander cylinder crankshaft operatively connected to and rotatably driven by a piston 28A. The three crankshafts 30, 32, and 34 are operatively connected to each other for coordinated rotation. Crankshafts 30, 32, and 34 may also be connected for synchronous rotation. A split-cycle engine having more than two power cylinders is also envisioned. Depending on the actual number of power cylinders employed, respective compressor, power, and expander crankshafts may also be connected such that all three crankshafts rotate either at the same speed or at a predetermined speed ratio, as understood by those skilled in the art.

An initial downward stroke of each respective piston 24A, 26A after the firing of the air-fuel mixture inside respective cylinders 24, 26 generates power to rotate crankshaft 32. Consequently, each successive firing inside the cylinders 24, 26 maintains rotation of the crankshaft 32, and transfers rotational motion to crankshafts 30 and 34 via intermeshed gears 36, 38, and 40. After each firing of each power cylinder 24, 26, the respective power cylinder on its upstroke expels the post-combustion exhaust gases, and transfers such gasses to expander cylinder 28 via exhaust transfer ports 24C and 26C. The expander piston 28A is in turn displaced or driven by the expansion of the exhaust gases received from power cylinder 24, 26. Hence, the energy contained in the transferred exhaust gasses in the form of heat and pressure is thereby used to create additional mechanical work by displacing expander piston 28A and rotating crankshaft 34.

Figure 2:
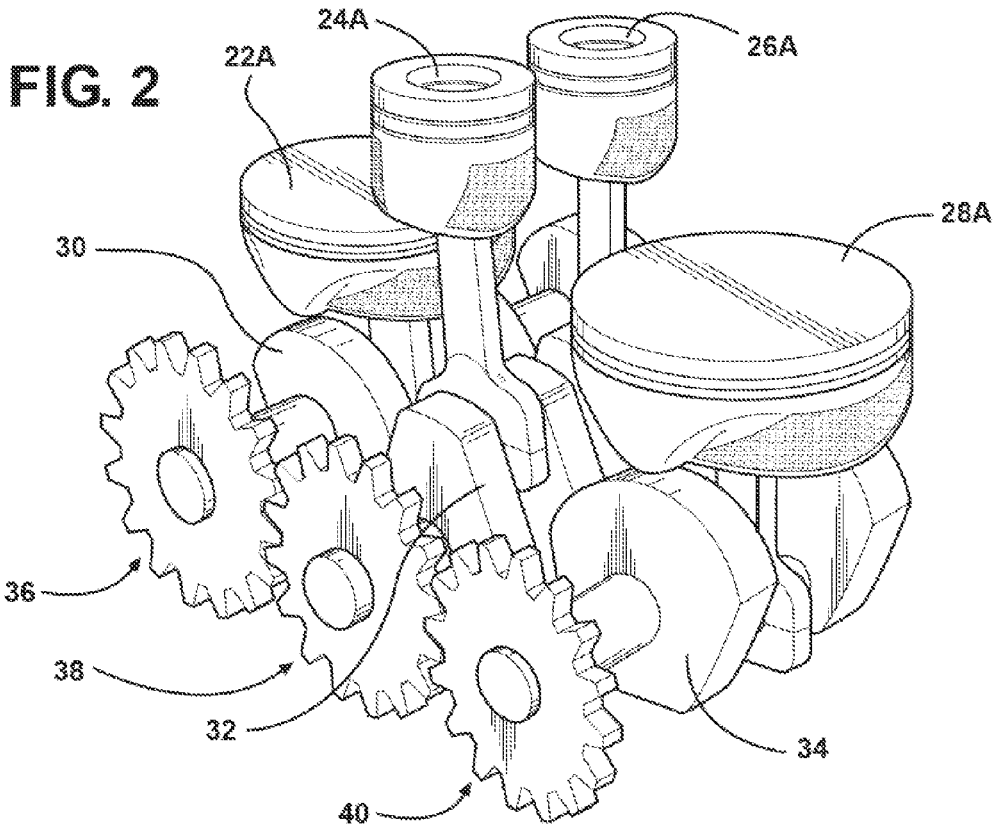
FIG. 2 is a close-up perspective partial view of the split-cycle internal combustion engine employing intermeshed gears to connect the three crankshafts.

As shown in FIGS. 1 and 2, the coordinated rotation of three crankshafts 30, 32, and 34 is achieved via three intermeshed gears, each connected to one of the subject crankshafts. Gear 36 is connected to crankshaft 30; gear 38 is connected to crankshaft 32; and gear 40 is connected to crankshaft 34. Gears 36 and 40 have teeth 36A and 40A, respectively. Teeth 36A and 40A are characterized by a similarly handed helix. Gear 38 has teeth 38A that are characterized by a helix that is opposite to that of the gears 36 and 40, thus permitting the three gears 36, 38, 40 to mesh, and provide coordinated rotation of crankshafts 30, 32, 34. A helix is employed in meshed gears 36, 38, 40 to allow for quieter operation of engine 18, through continuous contact between gears and reduction of gear lash, as understood in the art.

Rotational direction of gears 36, 38, 40 may be modified with an idler gear (not shown), if needed, such as for the purposes of balancing engine 18, as understood by those skilled in the art. Coordinated rotation of crankshafts 30, 32, 34 may also be achieved by non-intermeshed, non-contacting gears, with the distance between the gears spanned by a chain drive (not shown, but as understood by those skilled in the art). Such a chain drive may include a tensioner to keep the chain drive taut during operation of engine 18.

Figure 3:
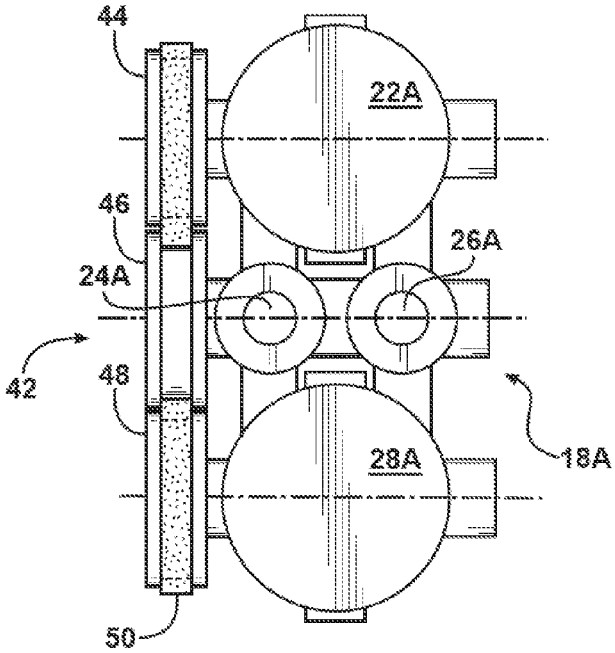
FIG. 3 is a schematic top partial view of the split-cycle internal combustion engine employing a belt-drive to connect the three crankshafts.

FIG. 3 depicts a split-cycle engine 18A, which is identical to engine 18 shown in FIGS. 1 and 2 in all regards other than having a belt-drive 42, with each identical element numbered accordingly. As shown in FIG. 3, coordinated rotation of crankshafts 30, 32, 34 may also be achieved by a belt-drive 42. Belt-drive 42 includes a pulley 44 connected to crankshaft 30, pulley 46 connected to crankshaft 32, and pulley 48 connected to crankshaft 34. A belt 50 spans the distance between the pulleys 44, 46, and 48, to thereby operatively interconnect crankshafts 30, 32, and 34. Belt-drive 42 may include a tensioner (not shown) to keep the belt 50 taut during operation of engine 18A. While only a single belt 50 is shown, belt-drive 42 may include a plurality of belts as required.

As shown in FIGS. 1-3, in engines 18 and 18A piston compressor 22 and piston expander 28 are positioned on opposite sides of, and in close proximity to power cylinders 24 and 26. Such positioning of piston compressor 22 and piston expander 28 permits the shortest length of intake transfer ports 24B and 26B and exhaust transfer ports 24C and 26C. The minimized length of exhaust transfer ports 24C and 26C is especially beneficial, in order to reduce heat loss and thereby transfer a higher percentage of the exhaust gas energy to cylinder expander 28. Such configuration facilitates reduction of the length of engines 18 and 18A. Furthermore, compressor and expander cylinder crankshafts (such as 30 and 34, respectively) may be additionally configured as specifically weighted balance shafts to offset vibrations in engine designs that are not inherently balanced, such as employing two or four power cylinders. Providing such a counterbalance to the motion of reciprocating cylinders is an effective method to smooth-out operation of engines 18 and 18A, as understood by those skilled in the art.

While the best modes for carrying out the invention have been described in detail, those familiar with the art to which this invention relates will recognize various alternative designs and embodiments for practicing the invention within the scope of the appended claims.

The invention claimed is:

1. A split-cycle internal combustion engine comprising:

a cylinder block;

a plurality of cooperating power pistons and cylinders mounted in the cylinder block, the power pistons configured to be energized by forces of combustion;

a compressor piston and cylinder mounted in the cylinder block and configured to compress a volume of air and transfer the compressed air to the power pistons;

an expander piston and cylinder mounted in the cylinder block and configured to receive exhaust gases from the power pistons;

a first crankshaft operatively connected to and rotatably driven by the power pistons;

a second crankshaft operatively connected to the compressor piston and configured to rotatably drive the compressor piston; and a third crankshaft operatively connected to the expander piston and configured to be rotatably driven by the expander piston;

wherein the first, second, and third crankshafts are operatively connected to each other for coordinated rotation.

2. The engine according to claim 1, wherein the first, second, and third crankshafts are disposed alongside and parallel relative to each other.

3. The engine according to claim 1, further comprising an intake port configured to transfer the compressed air from the compressor piston to each of the cooperating power pistons, and an exhaust port configured to transfer exhaust gases from each of the cooperating power pistons to the expander piston, the intake and exhaust ports are arranged such that the compressor piston is positioned on one side of the plurality of cooperating power pistons, and the expander piston is positioned on the opposite side of the plurality of cooperating power pistons.

4. The engine according to claim 1, further comprising first, second, and third interconnected gears, wherein the first gear is connected to the first crankshaft, the second gear is connected to the second crankshaft, and the third gear is connected to the third crankshaft.

5. The engine according to claim 4, wherein the first, second, and third gears are interconnected via at least one chain.

6. The engine according to claim 4, wherein the first, second, and third gears are intermeshed.

7. The engine according to claim 6, wherein the first gear has a handed helix, and the second and third gears have an oppositely handed helix as compared to the handed helix of the first gear.

8. The engine according to claim 1, further comprising first, second, and third pulleys, wherein the first pulley is connected to the first crankshaft, the second pulley is connected to the second crankshaft, and the third pulley is connected to the third crankshaft, and the first, second and third pulleys are operatively connected via at least one belt.

9. The engine according to claim 1, wherein the first, second, and third crankshafts are operatively connected for synchronous rotation.

10. The engine according to claim 1, wherein the second and third crankshafts are configured as balance shafts for smoothing-out operation of the engine.

11. A vehicle comprising:

a body;

a plurality of wheels;

a split-cycle internal combustion engine including:

a cylinder block;

a plurality of cooperating power pistons and cylinders mounted in the cylinder block, the power pistons configured to be energized by forces of combustion;

a compressor piston and cylinder mounted in the cylinder block and configured to compress a volume of air and transfer the compressed air to the power pistons;

an expander piston and cylinder mounted in the cylinder block and configured to receive exhaust gases from the power pistons;

a first crankshaft operatively connected to and rotatably driven by the power pistons;

a second crankshaft operatively connected to the compressor piston and configured to rotatably drive the compressor piston;

a third crankshaft operatively connected to the expander piston and configured to be rotatably driven by the expander piston;

wherein the first, second, and third crankshafts are operatively connected to each other for coordinated rotation; and a driveline connecting the split-cycle internal combustion engine to at least one of the plurality of wheels for powering the vehicle.

12. The vehicle according to claim 11, wherein the first, second, and third crankshafts are disposed alongside and parallel relative to each other.

13. The vehicle according to claim 11, further comprising an intake port configured to transfer the compressed air from the compressor piston to each of the cooperating power pistons, and an exhaust port configured to transfer exhaust gases from each of the cooperating power pistons to the expander piston, the intake and exhaust ports are arranged such that the compressor piston is positioned on one side of the plurality of cooperating power pistons, and the expander piston is positioned on the opposite side of the plurality of cooperating power pistons.

14. The vehicle according to claim 11, further comprising first, second, and third interconnected gears, wherein the first gear is connected to the first crankshaft, the second gear is connected to the second crankshaft, and the third gear is connected to the third crankshaft.

15. The vehicle according to claim 14, wherein the first, second, and third gears are interconnected via at least one chain.

16. The vehicle according to claim 14, wherein the first, second, and third gears are intermeshed.

17. The vehicle according to claim 16, wherein the first gear has a handed helix, and the second and third gears have an oppositely handed helix as compared to the handed helix of the first gear.

18. The vehicle according to claim 11, further comprising first, second, and third pulleys, wherein the first pulley is connected to the first crankshaft, the second pulley is connected to the second crankshaft, and the third pulley is connected to the third crankshaft, and the first, second, and third pulleys are operatively connected via at least one belt.

19. The vehicle according to claim 11, wherein the first, second, and third crankshafts are operatively connected for synchronous rotation.

20. The vehicle according to claim 11, wherein the second and third crankshafts are configured as balance shafts for smoothing-out operation of the engine.

* * * * *